US005906013A

United States Patent [19]

Wang

[11] Patent Number: 5,906,013

[45] Date of Patent: May 25, 1999

[54] PIVOTAL DEVICE FOR A PLAYPEN

[76] Inventor: Kun Wang, No. 51, Lane 31, Sec. 2, Changping Rd., Taichung, Taiwan

[21] Appl. No.: 08/835,090

[22] Filed: Apr. 4, 1997

[51] Int. Cl.[6] ..... A47C 9/00

[52] U.S. Cl. ..... 5/99.1; 5/102; 5/93.1; 403/325; 403/102

[58] Field of Search ..... 5/99.1, 102, 98.2, 5/93.1, 174, 177, 202, 249, 250; 108/162, 115; 403/102, 100, 101, 315, 321, 325

[56] References Cited

U.S. PATENT DOCUMENTS

| | | | |
|---|---|---|---|
| 5,474,404 | 12/1995 | Chien | 5/99.1 |
| 5,485,655 | 1/1996 | Wang | 5/99.1 |
| 5,611,634 | 3/1997 | Wang | 5/99.1 |
| 5,730,542 | 3/1998 | Cheng | 5/99.1 |

*Primary Examiner*—Michael F. Trettel
*Assistant Examiner*—Fredrick Conley
*Attorney, Agent, or Firm*—Heller Ehrman White & McAuliffe

[57] ABSTRACT

A pivotal device for a playpen includes a connecting member which pivotally connects two siderails of the playpen. Each of the siderails has a spring received therein which has a protrusion extending through the siderail and the connecting member and a pushing end being accessed via a hole of the connecting member. An operation plate mounted to the connecting member with a slidable member biasedly disposed therebetween. The operation plate has flexible plate and a head with a tapered surface extends laterally from the flexible plate, the slidable member having one end thereof slidably located below the head so that when the slidable member is shifted, the head is pushed to push the pushing ends of the springs to withdraw the protrusions from the connecting member to allow the siderails to be pivoted.

4 Claims, 6 Drawing Sheets

PIVOTAL DEVICE FOR A PLAYPEN

BACKGROUND OF THE INVENTION

1. Field of the Invention

The present invention relates to a pivotal device and, more particularly, to an improved pivotal device for a playpen and having a locking mechanism disposed thereto so as to prevent it from being unintentionally activated.

2. Brief Description of the Prior Art

Generally, a conventional playpen is designed for children to play therein and usually has a pivotal device disposed between two siderails of the playpen so that the playpen is able to be folded so as to occupy less space while not in use. Although the pivotal devices of some of conventional playpens have a common feature of being easily operated to fold or to extend the playpens, they lack a locking feature such that the pivotal device could be unintentionally actuated by children and the playpen could collapse suddenly, and the children in the playpen could be hurt. A latest related pivotal device for a playpen known to Applicant is Applicant's U.S. Pat. No. 5,611,634, entitled as "Pivotal Device for a Playpen". Applicant wants to design a pivotal device used on playpen and which has a reliable two-step operation locking function.

The present invention intends to provide an improved pivotal device for connecting two siderails of a playpen and the pivotal device has a locking mechanism disposed thereto which effectively mitigates and/or obviates the above-mentioned problems.

SUMMARY OF THE INVENTION

The present invention provides a pivotal device for a playpen and comprises a connecting member which has a front plate, a rear plate connected to the front plate by a top portion, and two open ends between the front plate and the rear plate for two siderails of the playpen respectively and pivotally inserted therethrough. Each of the siderails has a spring member received therein which has a pushing end and a protrusion extending therefrom. The front plate has two first holes defined therethrough and a second hole defined between the two first holes so that each of the protrusions respectively and biasedly extends through a third hole defined in the respective siderail and the first hole corresponding thereto.

An operation plate is fixedly disposed to the front plate of the connecting member. Two fourth holes are defined in the operation plate and each share a common axis of the first hole corresponding thereto. A fifth hole is defined between the two fourth holes. The operation plate has a first recess defined in a rear side thereof facing the front plate so as to form a convex portion extending from a front side of the operation plate. The convex portion has a sixth hole defined therein and a flexible plate extends upwardly from a Lop defining the sixth hole, the flexible plate having a head extending laterally therefrom and through the fifth hole and the second hole to contact the pushing ends of the two spring members wherein the head has a tapered surface defined in an under side thereof. An extending block extends from the top defining the sixth hole so as to define an open area above the top defining the sixth hole. A second recess is defined in the rear side of the operation plate and communicates with the first recess.

A slidable member is slidably received in the first recess with at least one spring biasedly disposed between one end of the slidable member and a side of the convex portion so as to push the other end of the slidable member located below the flexible plate. A lever extends laterally from the slidable member and through the sixth hole of the convex portion.

A rod has a first section and a second section which extends inclinedly from the first section and is positioned below the head of the flexible plate. The first section has two pins extending from two opposite sides thereof so as to pivotally support the rod between the extending block and the front side of the operation plate so that the head can be pushed to push the two pushing ends to withdraw the protrusions from the first holes and the fourth holes by shifting the lever of the slidable member.

It is an object of the present invention to provide a pivotal device for a playpen and which has a slidable member to control whether the pivotal device can be operated.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
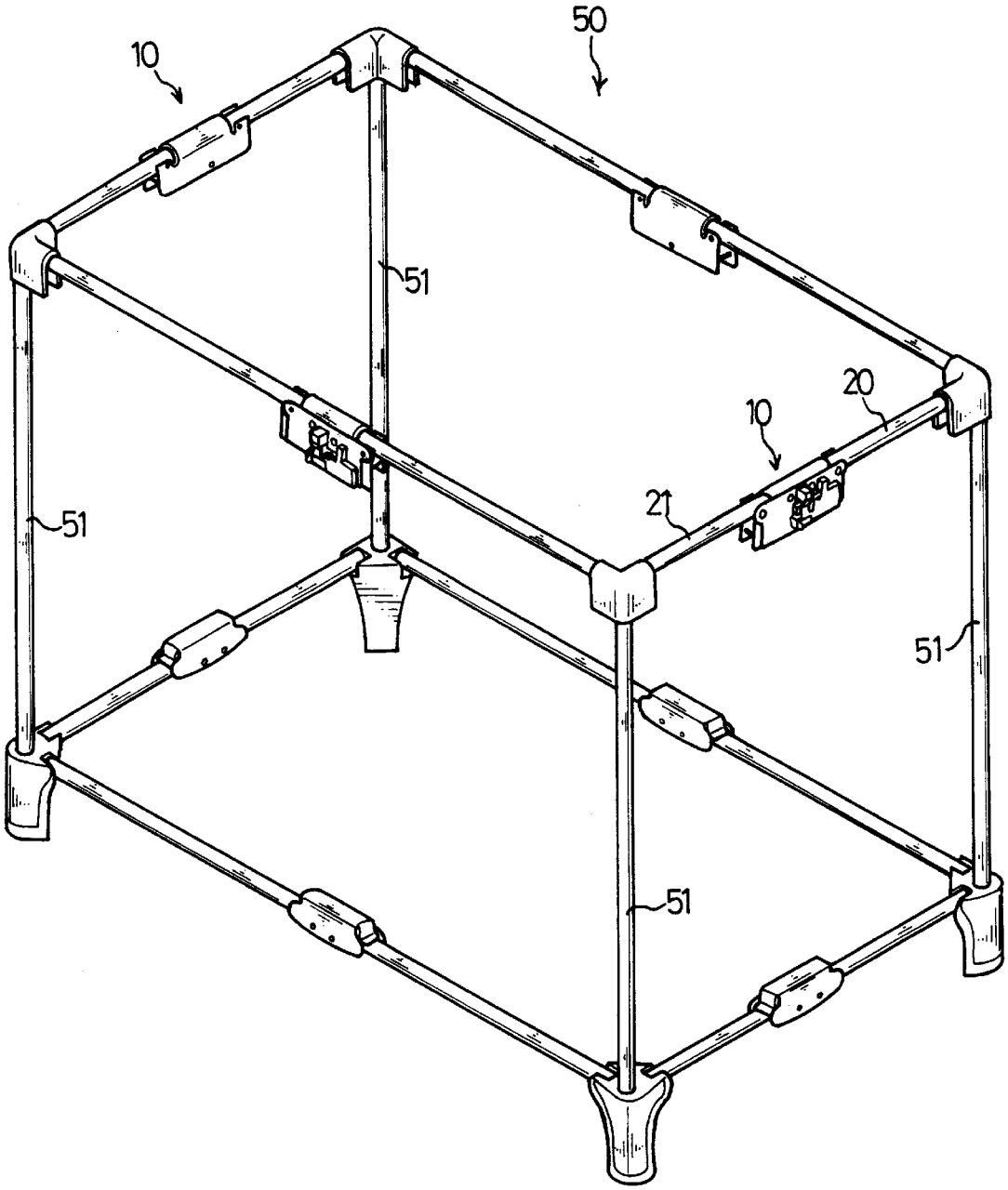
FIG. 1 is a perspective view of a playpen having pivotal devices in accordance with the present invention disposed thereto.
Figure 2:
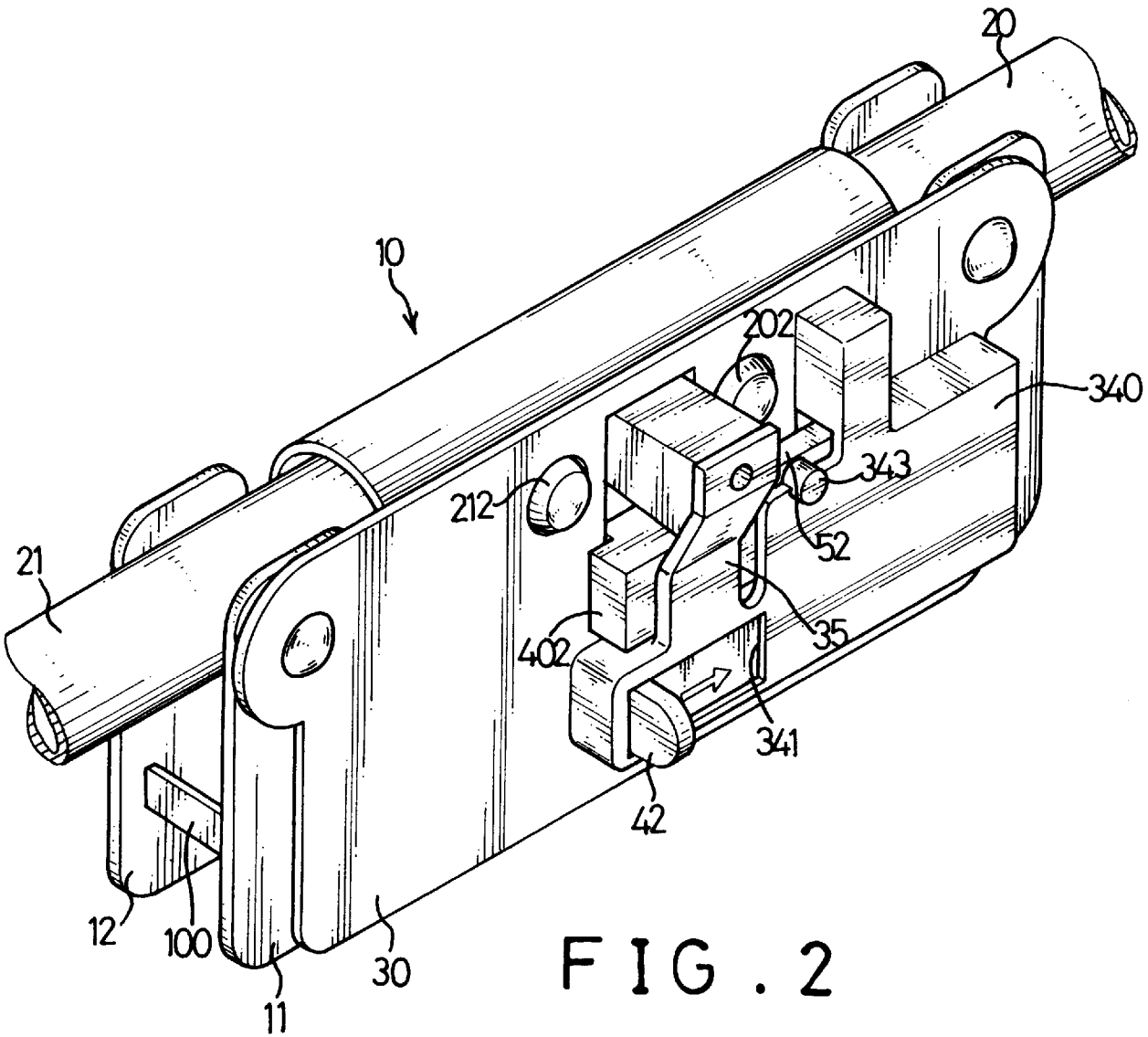
FIG. 2 is a perspective view of the pivotal device in accordance with the present invention.
Figure 3:
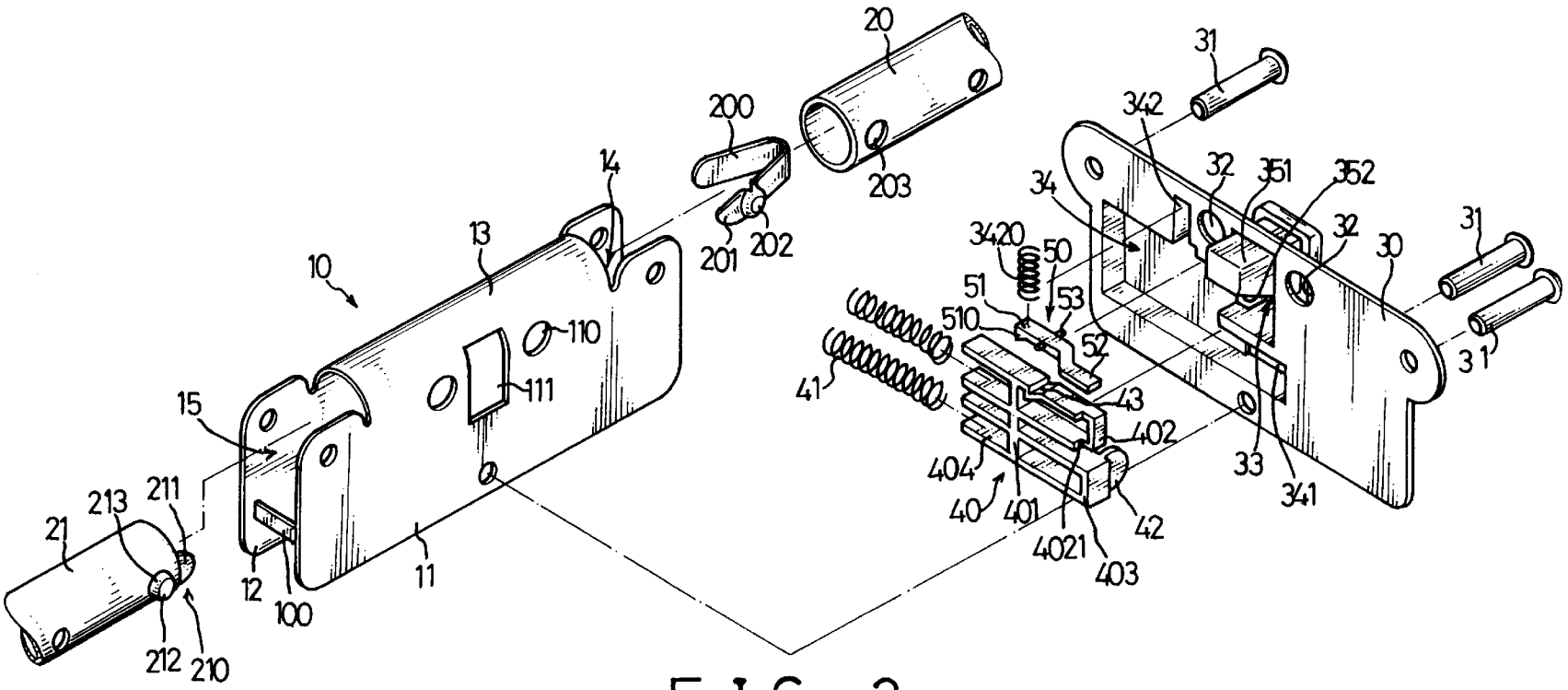
FIG. 3 is an exploded view of the pivotal device in accordance with the present invention.

Referring to the drawings and initially to FIGS. 1 through 3, a playpen 50 has a bottom with four posts 51 extending upwardly therefrom. Two siderails 20, 21 are pivotally connected together between each of two posts 51 by a pivotal device in accordance with the present invention. The pivotal device generally includes a connecting member 10 having a front plate 11, a rear plate 12 which is connected to the front plate 11 by a top portion 13, and two open ends 14, 15 for the two siderails 20, 21 respectively and pivotally inserted therethrough wherein each of the siderails 20, 21 has a spring member 200/210 received therein. The front plate 11 has two first holes 110 defined therethrough and a second hole 111 is defined between the two first holes 110. Each of the spring members 200, 210 has a pushing end 201/211 and a protrusion 202/212 extending therefrom which is biasedly extending through a third hole 203/213 defined in the respective siderail 20/21 and the first hole 110 corresponding thereto.

An operation plate 30 is fixedly disposed to the front plate 11 of the connecting member 10 with three rivets 31 wherein two rivets 31 respectively extend through the operation plate 30, the connecting member 10 and the two siderails 20, 21 between the front plate 11 and the rear plate 12 so that the siderails 20, 21 are pivotally connected to the connecting member 10. Two fourth holes 32 are defined in the operation plate 30 and each share a common axis of the first hole 110 corresponding thereto, and a fifth hole 33 defined between the two fourth holes 32. The operation plate 30 has a first recess 34 defined in a rear side thereof facing the front plate 11 so as to form a convex portion 340 extending from a front side of the operation plate 30. The convex portion 340 has a sixth hole 341 defined therein and a flexible plate 35 extends upwardly from a top defining the sixth hole 341 wherein the flexible plate 35 has a head 351 extending laterally therefrom and through the fifth hole 33 and the second hole 111 to contact the pushing ends 201, 211 of the two spring members 200, 210. An extending block 343 extends from the top defining the sixth hole 341 so as to define an open area above the top defining the sixth hole 341. The head 351 has a tapered surface 352 defined in an under side thereof.

A second recess 342 is defined in the rear side of the operation plate 30 and communicates with the first recess 34. The second recess 342 is located beside one of the fourth holes 32, that one of the fourth holes 32 being located between the fifth hole 33 and the second recess 342.

A slidable member 40 is slidably received in the first recess 34 and has a middle plate 401 A first upper portion 402 and a first lower portion 403 extend from one of two sides of the middle plate 401. Two receiving portions 404 are defined in the other end of the middle plate 401. Each of the receiving portions 404 has at least one spring 41 biasedly disposed between one end defining the convex portion 340 and the middle plate 401 of the slidable member 40 so as to push the slidable member 40 toward the head 351. The first upper portion 402 has a recess 4021 defined in a rear side thereof so that an edge defining the fifth hole 33 of the operation plate 30 is received in the recess 4021 when the slidable member 40 is biased by the springs 41 wherein the first upper portion 402 is located below the head 351 so as to limit the head 351 from being pushed unintentionally. The first lower portion 403 of the slidable member 40 has a lever 42 extending laterally therefrom which extends through the sixth hole 341 of the convex portion 340. A notch 43 is defined in a top surface of the first upper portion 402 of the slidable member 40.

Figure 4:
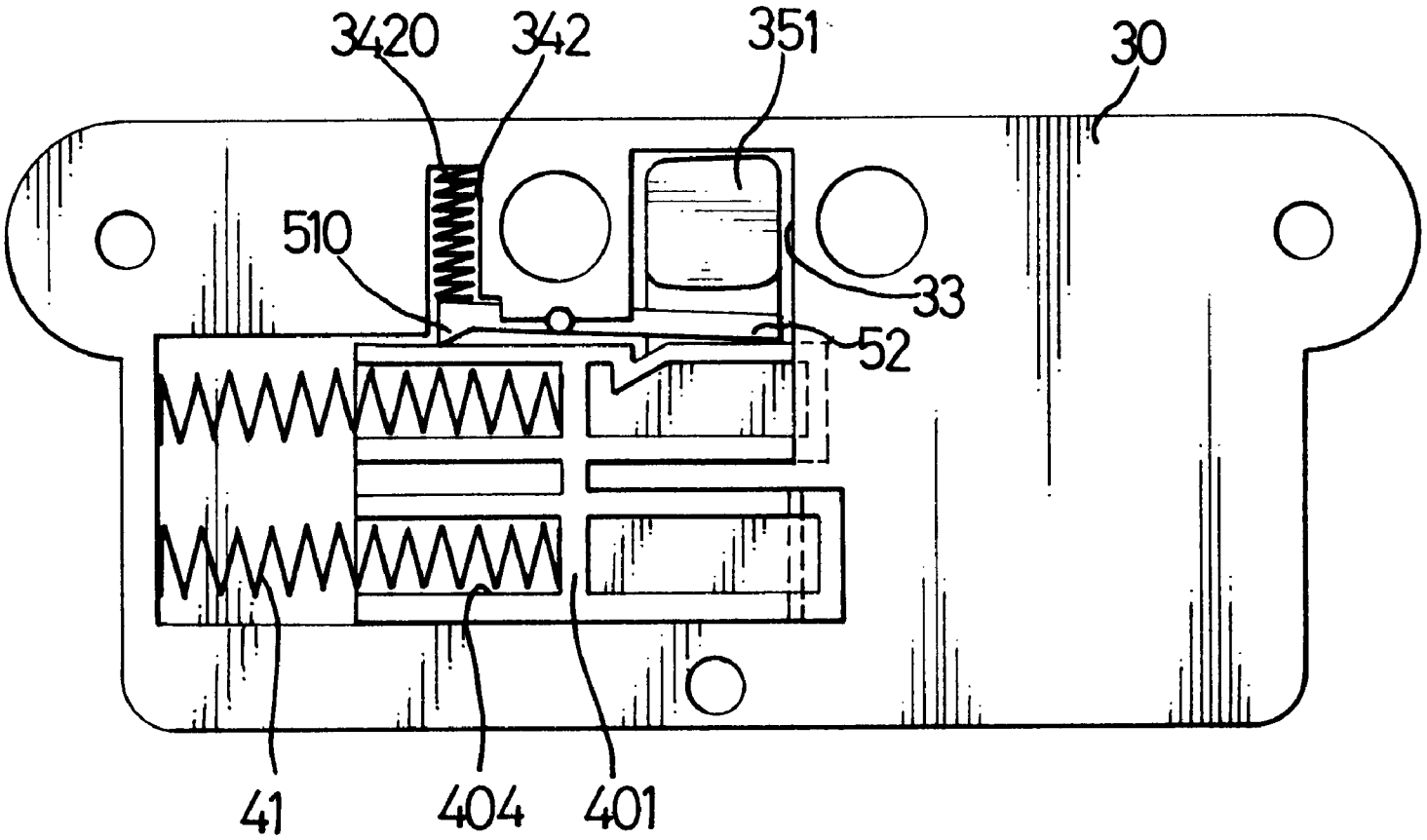
FIG. 4 is a plan view to show an arrangement of the plate, the slidable member and the head.

A rod 50 has a first section 51 and a second section 52 which extends inclinedly from the first section 51 wherein the first section 51 has two pins 53 extending from two opposite sides thereof so that the two pins 53 are respectively and pivotally supported between the extending block 343 and the front side of the operation plate 30. The first section 51 has a hook portion 510 extending downwardly therefrom and a spring 3420 is received in the second recess 342 so as to push the first section 51 of the rod 50 to contact the slidable member 40 as shown in FIG. 4.

Figure 5:
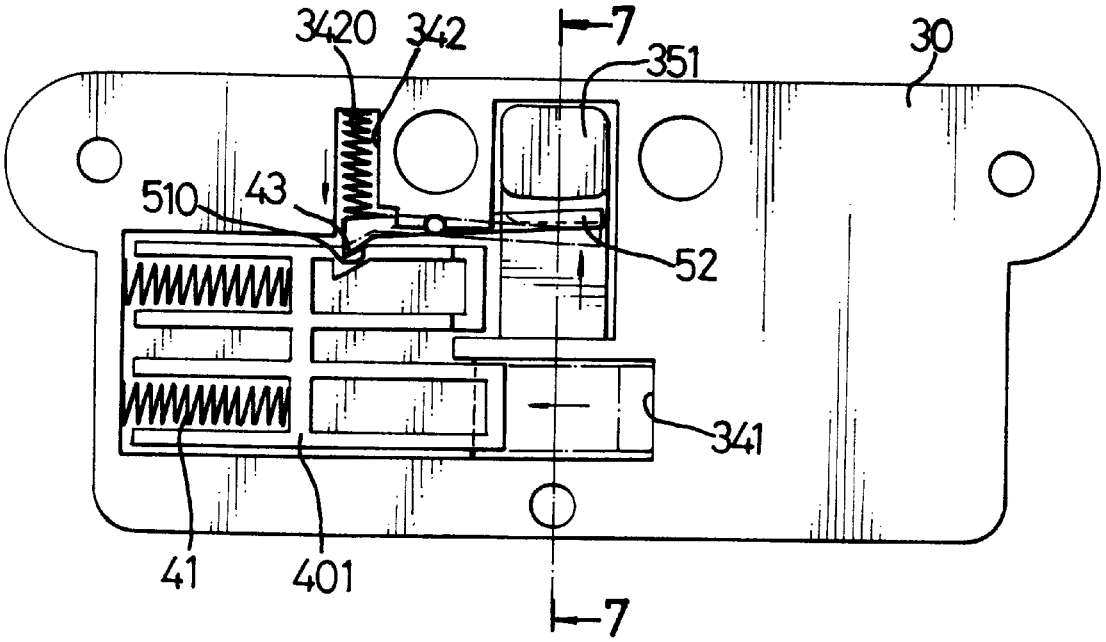
FIG. 5 is a plan view to show an arrangement when the slidable member is shifted aside in a first recess in the plate.
Figure 6:
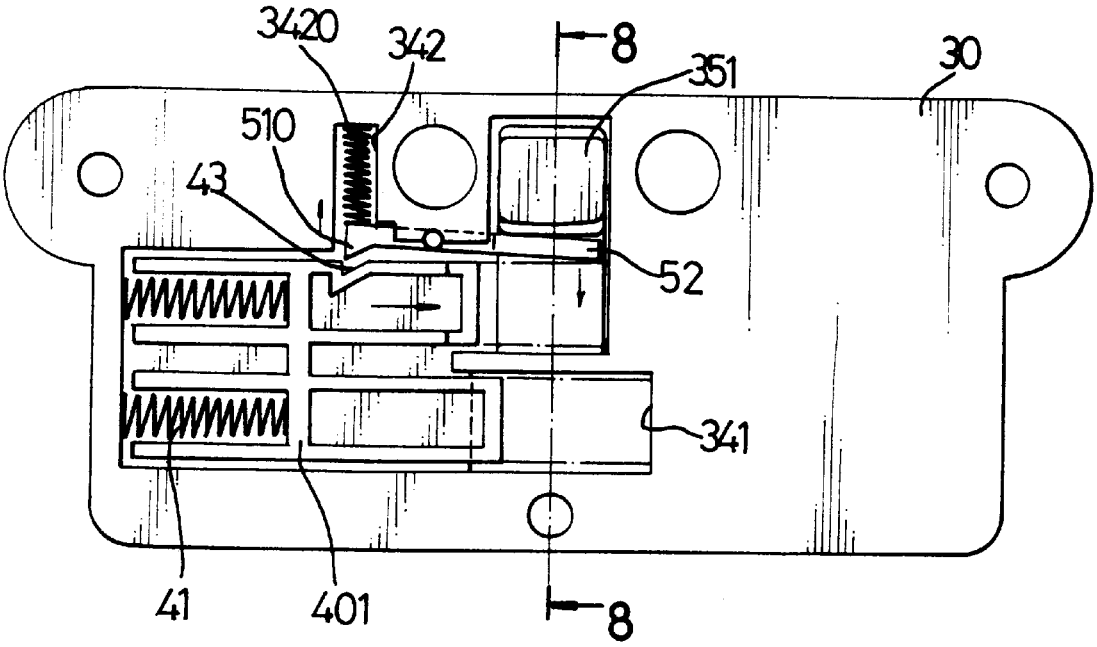
FIG. 6 is a plan view to show the head is pushed after the slidable member is shifted.
Figure 7:
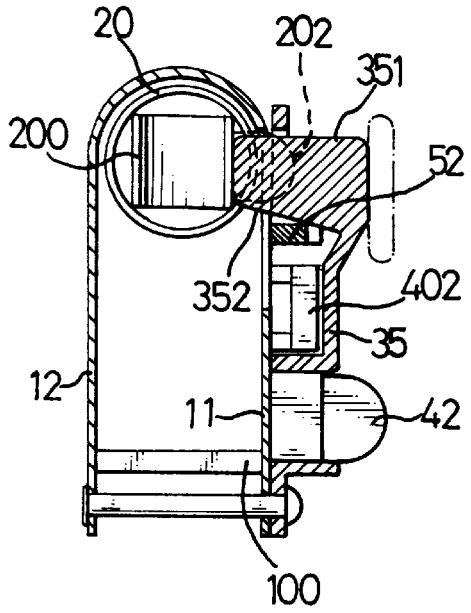
FIG. 7 is an illustrative view to show the pivotal device seen from one side thereof when the head is not yet pushed.
Figure 8:
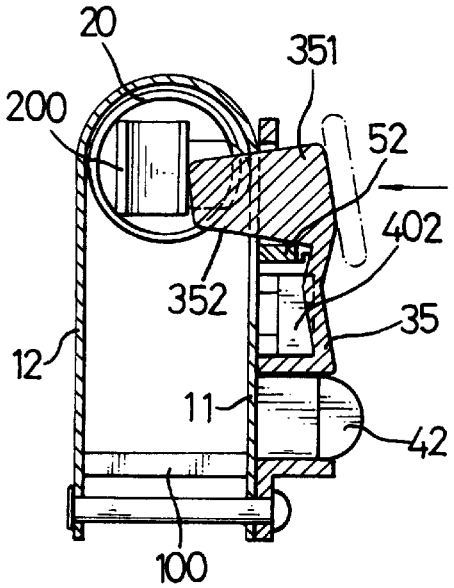
FIG. 8 is an illustrative view to show the pivotal device seen from one side thereof when the head is pushed.

Referring to FIGS. 5 and 6, when a user (not shown) wants to fold the playpen 50, he/she firstly shifts the lever 42 to let the slidable member 40 be shifted to depress the spring members 41 and the hook portion 510 is pushed by the spring 3420 to engage with the notch 43 to position the slidable member 40. Referring to FIGS. 6 and 8, the head 351 then can be pushed toward the connecting member 10 to push the two pushing ends 201, 211 and withdraw the protrusions 202, 212 from the fourth holes 32 and the first holes 110. During the action of pushing the head 351, the second section 52 is lowered by the tapered surface 352 of the head 351 so that the hook portion 510 of the first rod 50 is lifted to disengage from the notch 43 and the slidable member 40 returns to its original position after the head 351 is released.

Two stops 100 are connected between the front plate 11 and the rear plate 12 so that when the two siderails 20, 21 are pivoted and the protrusions 212, 202 are withdrawn from the first holes 110 of the connecting member 10, the stops 100 will limit the siderails 20, 21 when they contact the stops 100.

Accordingly, the pivotal device is controlled by the slidable member 40 so that an unintentional impact to the head 351 will not collapse the playpen 50 and the playpen 50 can be used in safety.

Although the invention has been explained in relation to this preferred embodiment, it is to be understood that many other possible modifications and variations can be made without departing from the spirit and scope of the invention as hereinafter claimed.

What is claimed is:

1. A pivotal device for a playpen and comprising:

a connecting member comprising a front plate, a rear plate which is connected to said front plate by a top portion, and two open ends for two siderails of said playpen respectively and pivotally inserted therethrough wherein each of said siderails has a spring member received therein, said front plate having two first holes defined therethrough and a second hole defined between said two first holes, each of said spring members having a pushing end and a protrusion extending therefrom which biasedly extends through a third hole defined in said respective siderail and said first hole corresponding thereto;

an operation plate fixedly disposed to said front plate of said connecting member, two fourth holes defined in said operation plate and each sharing a common axis of said first hole corresponding thereto, a fifth hole defined between said two fourth holes, said operation plate having a first recess defined in a rear side thereof facing to said front plate so as to form a convex portion extending from a front side of said operation plate, said convex portion having a sixth hole defined therein and a flexible plate extending upwardly from a top defining said sixth hole, said flexible plate having a head extending laterally therefrom and through said fifth hole and said second hole to contact said pushing ends of said two spring members, said head having a tapered surface defined in an under side thereof, an extending block extending from said top defining said sixth hole so as to define an open area above said top defining said sixth hole, a second recess defined in said rear side of said operation plate and communicating with said first recess, said second recess located beside one of said fourth holes;

a slidable member being slidably received in said first recess with at least one spring biasedly disposed between one end of said slidable member and a side of said convex portion so as to push said slidable member toward said head, the other end of said slidable member having a lever extending laterally therefrom which extends through said sixth hole of said convex portion, and a rod having a first section and a second section which extends inclinedly from said first section which has two pins extending from two opposite sides thereof, said second section being positioned below said head with said two pins respectively pivotally supported between said extending block and said front side of said operation plate so that said head can be pushed to push said two pushing ends to withdraw said protrusions from said fourth holes and said first holes by shifting said lever of said slidable member.

2. The pivotal device as claimed in claim 1 wherein said first section has a hook portion extending downwardly therefrom and said slidable member has a notch defined in a top surface thereof.

3. The pivotal device as claimed in claim 2 wherein said hook portion of said first rod is engaged with said notch when said slidable member is shifted to depress said spring member.

4. The pivotal device as claimed in claim 3 wherein said hook portion of said first rod is lifted to disengage from said notch when said second section is lowered by said tapered surface when said head is pushed.

* * * * *